US007350627B2

(12) United States Patent
Ketonen et al.

(10) Patent No.: US 7,350,627 B2
(45) Date of Patent: Apr. 1, 2008

(54) ELEVATOR ARRANGEMENT

(75) Inventors: Ari Ketonen, Hyvinkää (FI); Seppo Ketoviita, Hyvinkää (FI); Veli-Matti Vainio, Hyvinkää (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 11/593,557

(22) Filed: Nov. 7, 2006

(65) Prior Publication Data

US 2007/0181377 A1 Aug. 9, 2007

Related U.S. Application Data

(63) Continuation of application No. PCT/FI2005/000229, filed on May 18, 2005.

(30) Foreign Application Priority Data

Jun. 7, 2004 (FI) ..... 20040777

(51) Int. Cl.
*B66B 13/28* (2006.01)
*B66B 1/28* (2006.01)
*B66B 5/16* (2006.01)

(52) U.S. Cl. ..... 187/400; 187/279; 187/359

(58) Field of Classification Search ..... 187/359, 187/400

See application file for complete search history.

(56) References Cited

U.S. PATENT DOCUMENTS 4,091,906 A * 5/1978 Clarke et al. ..... 192/129 A
4,556,129 A * 12/1985 Martin ..... 187/279
6,095,288 A 8/2000 Rivera et al.
6,182,798 B1 * 2/2001 Brady et al. ..... 187/282

FOREIGN PATENT DOCUMENTS

| | | | |
|---|---|---|---|
| DE | 203 13 911 U1 | | 12/2003 |
| EP | 1 118 576 A2 | | 7/2001 |
| FR | 2 841 886 A1 | | 1/2004 |
| JP | 8-319070 A | | 12/1996 |
| JP | 08319070 A | * | 12/1996 |
| WO | WO-02/10053 A1 | | 2/2002 |
| WO | WO-02/060802 A2 | | 8/2002 |
| WO | WO02060802 A2 | * | 8/2002 |

* cited by examiner

*Primary Examiner*—Peter M. Cuomo
*Assistant Examiner*—Eric E. Pico
(74) *Attorney, Agent, or Firm*—Birch, Stewart, Kolasch & Birch, LLP

(57) ABSTRACT

The invention relates to a safety device arrangement for an elevator door opening, said safety device arrangement comprising at least a toe guard (3) placed substantially at the lower edge of the elevator car and a safety circuit (21) connected to the elevator system. The safety device arrangement comprises a safety circuit switch (16) placed on the toe guard (3) and a bypass switch (17) connected to the safety circuit (21), said bypass switch being fitted to bypass the safety circuit switch (16) at least when the elevator is at or close to the lowest landing floor.

5 Claims, 9 Drawing Sheets

ELEVATOR ARRANGEMENT

FIELD OF THE INVENTION

This application is a Continuation of co-pending PCT International Application No. PCT/FI2005/000229 filed on May 18, 2005, which designated the United States, and on which priority is claimed under 35 U.S.C. § 120. This application also claims priority under 35 U.S.C. § 119(a) on Patent Application No. 20040777 filed in Finland on Jun. 7, 2004. The entire contents of each of the above documents is hereby incorporated by reference.

BACKGROUND OF THE INVENTION

The present invention relates to a safety arrangement for an elevator door opening.

A safety device used in an elevator door opening is a foot guard, also called a toe guard, placed at the lower edge of the elevator car and having a length substantially at least equal to the width of the landing door opening. The toe guard is a plate-like piece or equivalent mounted in a substantially vertical plane, and it is designed to block the gap opening into the elevator shaft between the lower edge of the elevator and the floor surface of the landing e.g. when the elevator has stopped due to a failure so that the lower edge of the elevator car remains above the surface of the landing floor. This gap may be so large that a person escaping from the elevator can fall through the gap into the elevator shaft when descending from the car remaining above the surface of the landing floor. Likewise, without a toe guard there is a risk that a person who is working on a landing and loading or unloading e.g. a freight elevator remaining somewhat above the landing floor may inadvertently get so near the elevator shaft that his toes are in the shaft space. If the elevator car starts moving downwards in such a situation, there is a risk of the person's toes being injured. A toe guard functioning as a safety device prevents the occurrence of this type of hazards.

Regulations concerning safety of elevators specify the minimum height of the above-mentioned toe guard as 750 mm. A problem with the use of a toe guard of such a large height is that there is not enough room for the toe guard in a low elevator shaft pit when the elevator car comes e.g. to the lowest level. In prior-art elevator solutions, various attempts have been made to address this problem, either by making pivoted toe guard structures that can turn or slide under the elevator car or also by using telescoping structures. One problem is to see to it that the toe guard will not stop the elevator car when the elevator is coming to the lowest landing level in a shaft with a low pit. In this situation the safety circuit of the toe guard has to be bypassed to allow the drive current to be supplied to the elevator even in such a case. The safety circuit also needs to be bypassed in a repair or maintenance situation where the elevator car has to be driven to a level below the lowest landing floor, e.g. down to the buffers. In these situations, however, it must be made sure that the toe guard will return to its normal position after the elevator car has moved upwards from the lowest level. One further problem is to bypass the elevator's safety circuit in a way allowing the toe guard to work well as a protective element by stopping the movement of the elevator car if the toe guard hits an obstacle, such as a person's hand, foot or body, but at the same time so that the toe guard will not stop the elevator car when the elevator descends to the lowest level in a shaft with a low pit.

European patent application no. EP1118576 discloses a toe guard that can be folded or slid under the elevator car so that the elevator car can get closer to the bottom of the shaft. The solution according to this EP solution uses complex lever arms and guides for changing the position of the toe guard. The complex structure is more expensive and is additionally susceptible to damage. However, the specification does not resent any actual safety circuit or a circuit bypassing it, so there is also the problem that the elevator car will not necessarily stop even if the toe guard should hit an obstacle e.g. at floors other than the bottom floor.

U.S. Pat. No. 6,095,288 discloses a toe guard that turns on hinges under the elevator car. In this solution, the bottom of the shaft is provided with a surface inclined at an angle of about 45° which receive rollers provided at the lower edge of the toe guard when the elevator car comes to its lowest position, with the result that the toe guard, guided by the rollers, turns on its hinges to a position under the elevator car. One problem here is that the structure can become dirty, which may prevent the toe guard from being properly returned to the straight position or block the hinges so that the turning movement of the toe guard may become stiff, leading to a risk of breakdown of the whole structure. Neither does this solution propose a safety circuit or its bypass circuit, so in respect of safety this solution involves the same problems as the solution described above.

International patent specification no. WO 02/10053 also discloses toe guard solutions to address the aforesaid problem. The embodiment presented in FIGS. 4 and 5 is a complex turnable structure, which has the above-mentioned drawbacks. FIGS. 1-3 show a solution in which the structure comprises a telescoping toe guard with an external lower part moving vertically on a fixed internal upper part. A problem with the solution described in this specification is dirt, which can easily get into the open spaces between the moving parts, causing operational disturbances. This solution, too, has the drawback that it does not propose any kind of safety circuit, so there not necessarily anything to stop the elevator when the toe guard hits an obstacle.

SUMMARY OF THE INVENTION

The object of the present invention is to overcome the above-mentioned drawbacks and to achieve a reliably functioning safety device arrangement of economical cost for the door opening of an elevator, such as a toe guard connected to the elevator safety circuit so that, when the toe guard meets the bottom of a low elevator shaft, the safety circuit of the toe guard will not disconnect the supply of current to the elevator.

Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

The advantages of the elevator safety device of the invention include good safety and flexible operation in all situations as well as a good tolerance of dirt, allowing reliable operation of the safety device. A further advantage is that the solution of the invention enables a safety circuit without a logic-controlled double switch, so the circuit is simple and economical to implement. In addition, the safety device has a simple structure and allows the use of a toe guard of sufficient height in elevator shafts having a low pit. Moreover, the toe guard is automatically returned to its low position by gravity, thus obviating the need for complicated returning structures or resetting systems. Another advantage is that the toe guard of the invention can be installed on an existing elevator car without dismantling the old threshold structure. For mounting the toe guard, no additional components are needed, but the new toe guard fits directly in the place of the old one. A further advantage is a robust structure having a good tolerance of impacts, as well as the fact that no complex hinged solutions are needed. Yet another advantage is that the solution of the invention also allows the elevator car to be driven as far down as possible during maintenance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to an embodiment example and the attached drawings, wherein.

DETAILED DESCRIPTION OF THE INVENTION

Figure 1:
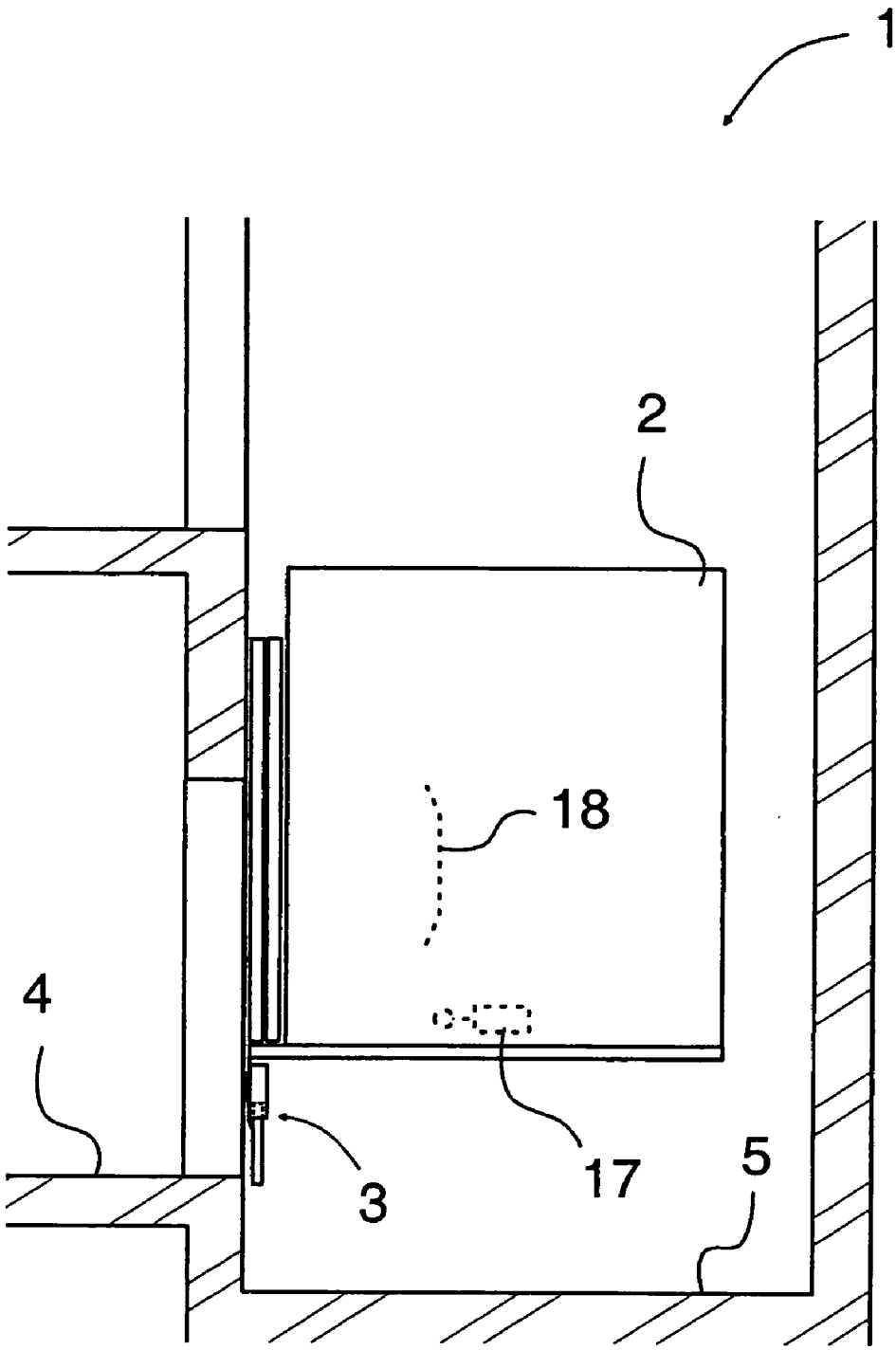
FIG. 1 is a diagram showing an elevator car in an elevator shaft, provided with one type of safety device according to the invention, above the lowest landing floor.

FIG. 1 presents a diagrammatic and simplified view of an elevator car 2 having stopped in the elevator shaft 1 at a position somewhat above the lowest landing floor 4. In the doorway, the gap opening into the elevator shaft between the lower edge of the elevator car and the landing floor 4 is covered by telescoping toe guard 3 extending downwards from the front edge of the elevator car 2 and having a total height larger than the height of the pit 5 of the elevator shaft.

Thus, people getting out of the elevator car having stopped in an exceptional position can not fall accidentally into the elevator shaft. On the bottom floor, such a fall is not as dangerous as in a similar situation on upper floors. FIG. 1 also shows a safety circuit bypass switch 17, depicted with broken lines and, in this embodiment, fastened to the lower part of the elevator car 2. The switch is controlled by a ramp 18 mounted on a side wall of the shaft 1.

Figure 2:
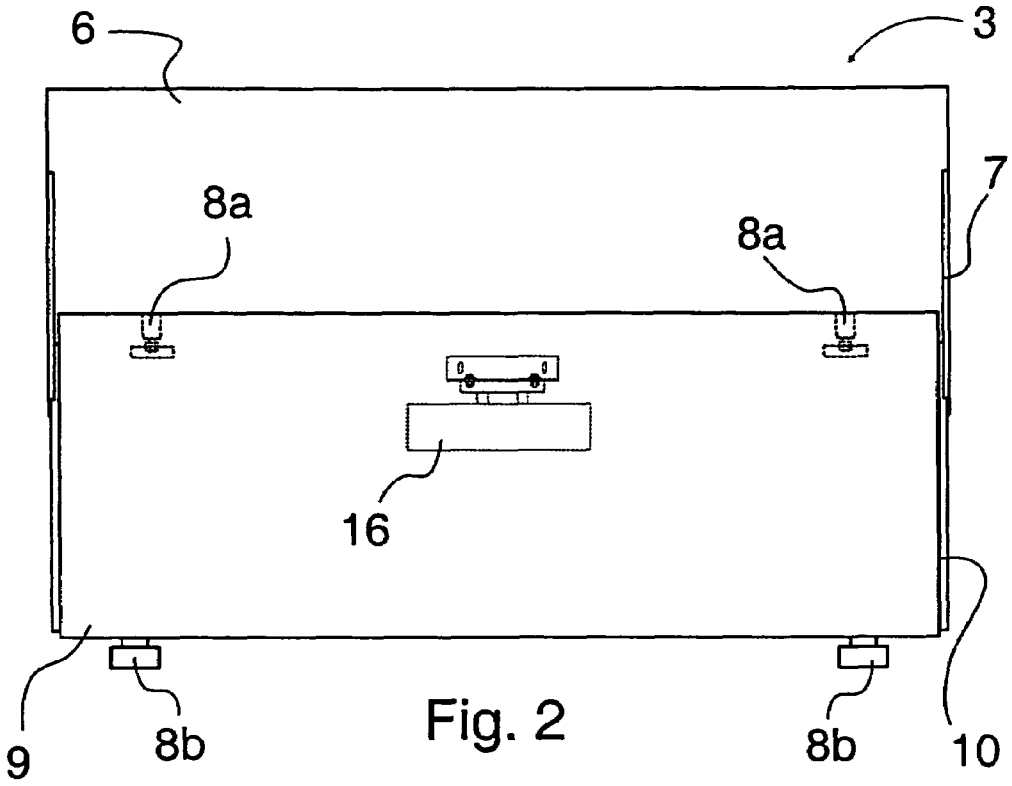
FIG. 2 presents the safety device of the invention as seen from behind
Figure 3:
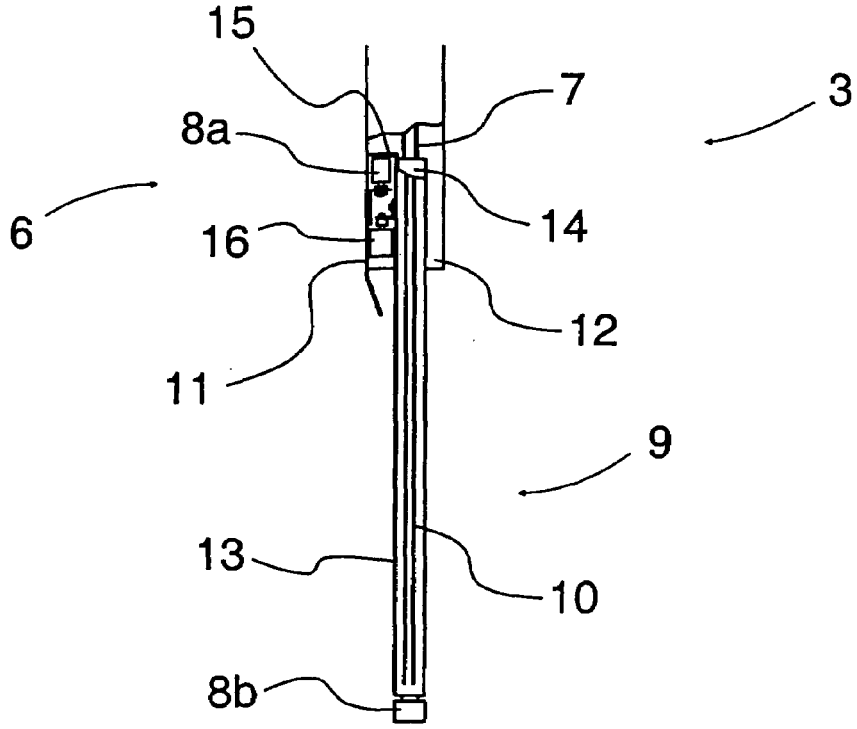
FIG. 3 presents the safety device of the invention in side view and partially sectioned.

FIGS. 2 and 3 present a toe guard 3 according to the invention as seen from behind, i.e. from the direction of the elevator shaft, and from one side and partially sectioned. An upper part 6 fixedly attached to the front edge of the elevator car 2 extends directly downwards from the front edge of the elevator car. At the lower edge of the planar front plate 11 of the upper part 6 is a fold turned obliquely inwards, i.e. towards the lower part 9. Similarly, the side edges of the upper part 6 have folds turned inwards substantially perpendicularly to the front plate 11 to form the side walls 12 of the upper part 6. Provided on the inner surface of the side walls 12 are substantially vertical guides 7 for guiding the vertical motion of the lower part 9.

Correspondingly, the lower part 9 consists of a planar front plate 13 and side walls 14 formed by folds turned inwards perpendicularly to the front plate. Provided on the outer surface of the side walls 13 are substantially vertical guide elements 10, such as slide bars or equivalent for controlling the vertical motion of the lower part 9 inside the upper part 6, so that the guide elements 10 are guided by the guides 7 in the upper part 6. In addition, the upper edge of the lower part 9 is provided with a fold 15 oriented in an outward, i.e. forward direction and serving to stop the motion of the lower part against the buffers 8*a* fastened to the bottom of the upper part 6. Thus, the lower part 9 can not fall down from inside the upper part 6. Moreover, the lower edge of the lower part 9 is provided with one or more buffers 8*b* serving to dampen the impact on the lower part 9 when the lower part hits the bottom of the elevator shaft. The inner surface of the lower part 6 is additionally provided with a safety circuit switch 16, the counterpart of which is placed in the upper part of the outer surface of the lower part 8.

FIGS. 4*a*-7*b* give a more detailed illustration of the connection of the safety circuit 21 of the toe guard 3 with the elevator car 2 at different heights. If the pit 5 of the elevator shaft is lower than the height of the toe guard 3 in the normal position, then the lower part 9 of the telescoping toe guard 3 is pushed upwards into the upper part 6 when the elevator car 2 comes to the lowest landing floor and the contact 16*a* of the switch 16 of the safety circuit 21 opens. In this situation, however, the open contact 16*a* must not produce a failure situation or cause the current to be switched off, so there is a separate bypass switch 17 fitted in the safety circuit 21. The contact 17*a* of the bypass switch bypasses the contact 16*a* of the safety circuit 21 when the elevator car 2 is at the lowest landing floor 4.

Figure 4A:
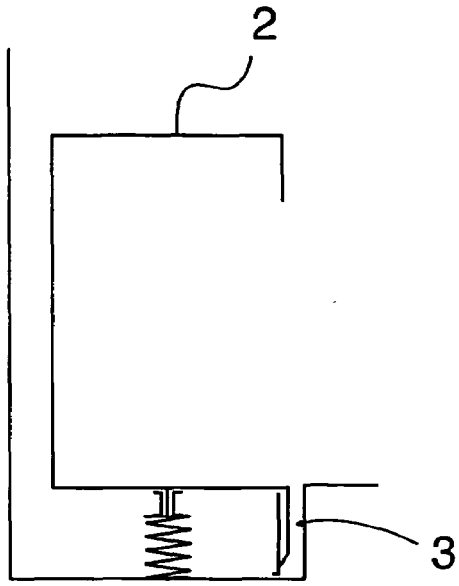
FIG. 4*a* presents a simplified diagrammatic side view of an elevator car at the lowest landing floor.
Figure 4B:
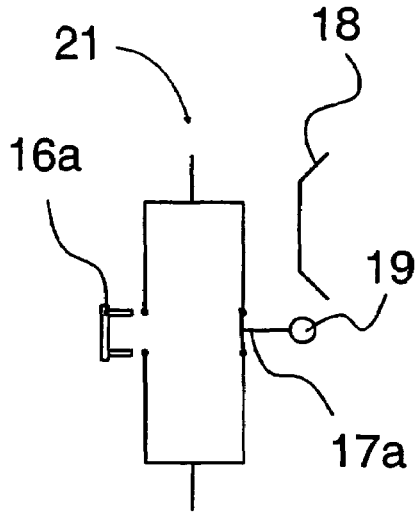
FIG. 4*b* presents a diagram of a safety circuit connection according to the invention when the elevator car is at the lowest landing floor as in FIG. 4*a*.

FIGS. 4*a* and 4*b* represent the aforesaid situation at the lowest landing floor 4. The elevator car 2 has descended to the lowest landing floor 4 and, due to the low pit, the lower part 9 of the toe guard 3 has been pushed upwards into the upper part 6. FIG. 4*b* shows that the contact 16*a* of the safety circuit switch 16 has opened, but as the bypass switch 17 is in its normal position below the ramp 18, the contact 17*a* of the bypass switch 17 is closed and bypasses the safety circuit 21 so that the elevator receives its normal operating current and no failure situation occurs.

Figure 5A:
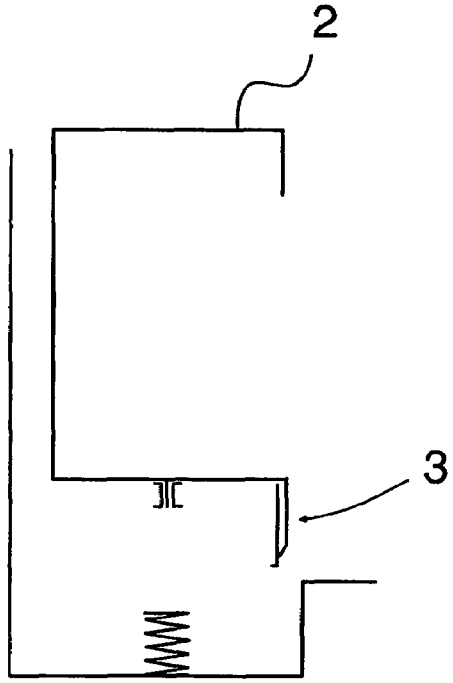
FIG. 5*a* presents a diagrammatic and simplified side view of an elevator car having just departed from the lowest landing floor, with the toe guard stuck in the high position.
Figure 5B:
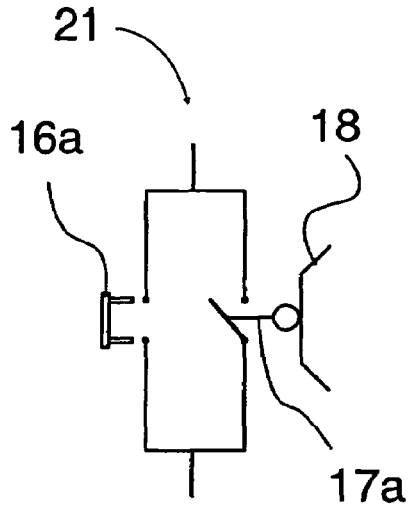
FIG. 5*b* presents a diagram of the safety circuit connection according to the invention in a failure situation when the elevator car is in a position as shown in FIG. 5*a*.

Correspondingly, FIGS. 5*a* and 5*b* represent a situation where the elevator car 2 has just started moving upwards from the lowest landing floor 4 and the lower part 9 of the toe guard 3 is stuck inside the upper part 6 and has not come down to its normal position as it should have. In this situation, the contact 16*a* of the switch 16 of the safety circuit 21 remains in the open position and, as the bypass switch 17 has met the ramp 18, contact 17*a* has also opened, so the safety circuit 21 has switched off the supply of operating current to the elevator and the elevator car 2 has stopped in consequence of the failure situation.

Figure 6A:
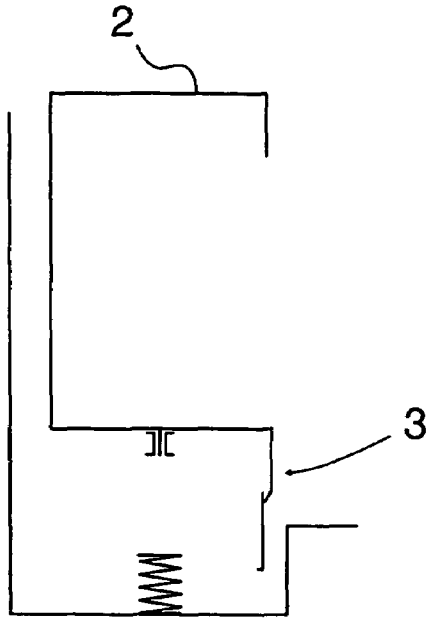
FIG. 6*a* presents a diagrammatic and simplified side view of an elevator car having just left the lowest landing floor and with the toe guard returned to the low position.
Figure 6B:
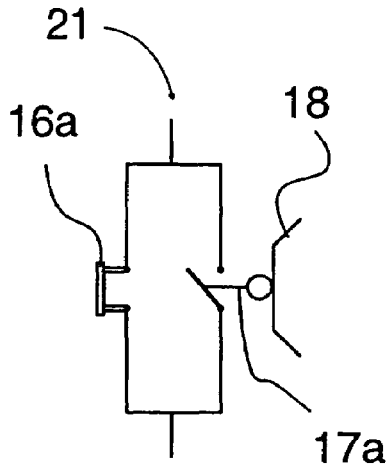
FIG. 6*b* presents a diagram of the safety circuit connection of the invention in a normal situation when the elevator car is in a position as shown in FIG. 6*a*.

FIGS. 6*a* and 6*b* represent a situation corresponding to FIGS. 5*a* and 5*b* when the lower part 9 of the toe guard 3 has come down to its normal low position after the departure of the elevator car 2. In this case, the contact 16*a* of the safety circuit switch 16 has closed and, when the bypass switch 17 has met the ramp 18, contact 17*a* has opened, but the safety circuit 21 still allows the flow of operating current via contact 16*a* and the elevator car 2 continues its upward movement in the normal way.

Figure 7A:
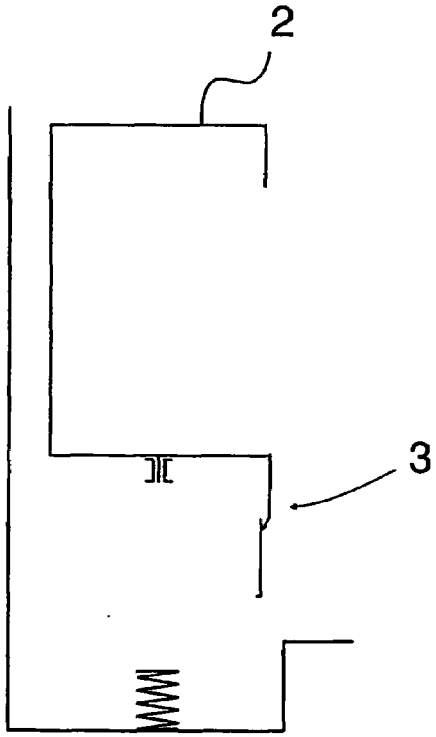
FIG. 7*a* presents a diagrammatic and simplified side view of an elevator car in an elevator shaft above the lowest landing floor and with the toe guard in the normal position.
Figure 7B:
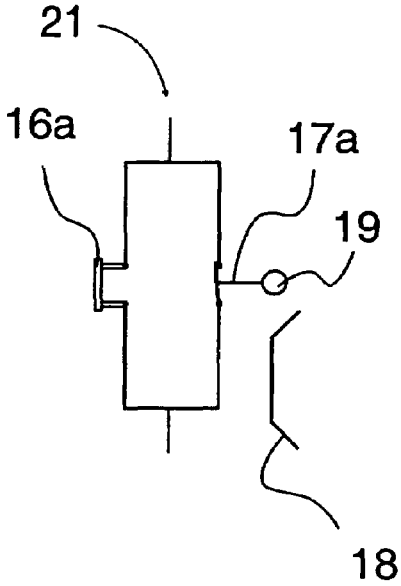
FIG. 7*b* presents a diagram of the safety circuit connection of the invention in a normal situation when the elevator car in a position as shown in FIG. 7*a*.

FIGS. 7*a* and 7*b* represent a normal situation when the elevator car 2 is at any position in the elevator shaft 1 so that the bypass switch 17 is above the ramp 18. In such a situation the lower part 9 of the toe guard 3 is in its normal low position, the contact 16*a* of the safety circuit switch 16 is closed and likewise the contact 17*a* of the bypass switch 17 is closed, so the safety circuit 21 allows the flow of operating current via contact 16*a* and the elevator car 2 moves normally.

Figure 8:
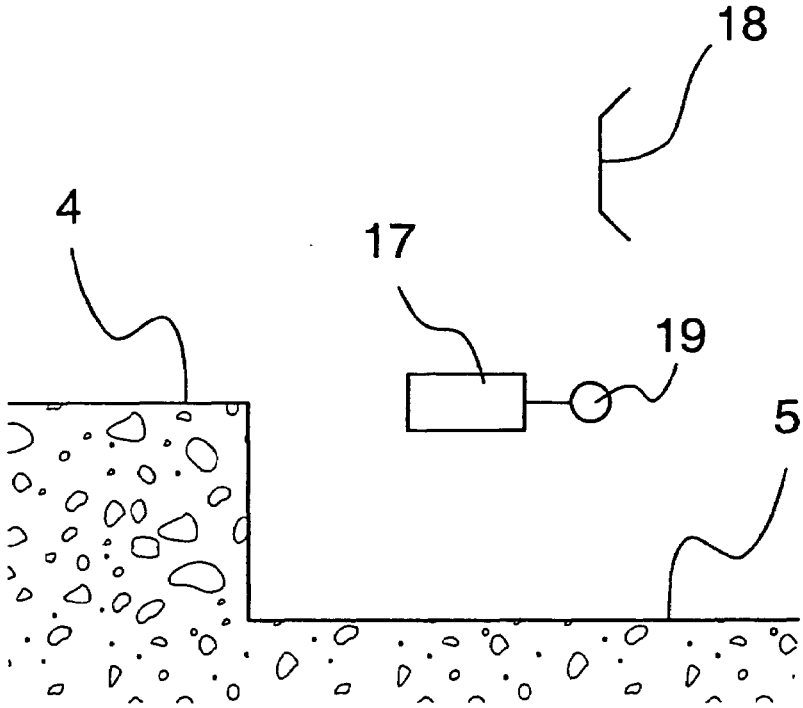
FIG. 8 presents a diagrammatic and simplified side view of a toe guard bypass switch and a ramp placed on a wall of the elevator shaft and designed to trigger the bypass switch.

FIG. 8 presents a more detailed illustration of the bypass switch 17 of the elevator safety circuit 21. The switch is provided with a roller-like follower element 19 placed at the end of a lever arm. The bypass switch 17 is mounted on the lower part of the elevator car 2, e.g. on the side of the elevator car. Correspondingly, attached to the wall of the elevator shaft at the lowest floor level 4 or close to it is a ramp 18 serving as a counterpart of the bypass switch 17 and consisting of e.g. a plate rail extending towards the elevator car 2 from the shaft wall. The upper and lower parts of the ramp are in an inclined position to allow the passage of the roller-like follower element 19, whereas the middle part of the ramp is in a substantially vertical position. The vertical distance of the lower part of the ramp 18 from the bypass switch 17 in its low position and the length of the middle part of the ramp are so designed that the elevator car 2 can not be accelerated to a speed high enough to prevent the elevator car in a failure situation from stopping at the ramp 18 when the roller-like follower element 19 meets the ramp 18. A suitable vertical distance with the commonly used elevator car speeds is e.g. in the range of 350-700 mm, and a suitable length of the middle part of the ramp 18 is e.g. about 1000 mm. When the elevator car 2 is at the lowest landing floor 4, the roller-like follower element 19 of the bypass switch 17 is below the ramp 18.

Figure 9:
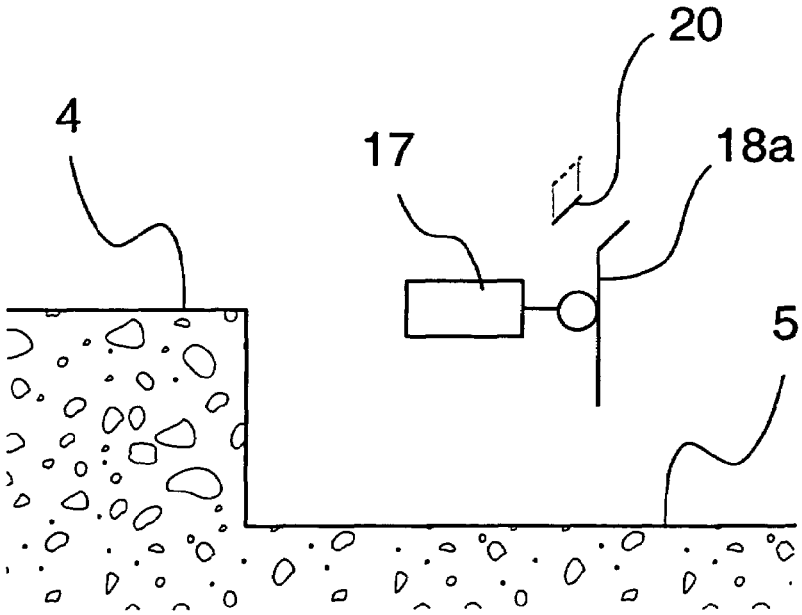
FIG. 9 presents a diagrammatic and simplified side view of a bypass switch according to a second embodiment of the invention and a ramp placed on a wall of the elevator shaft to trigger the bypass switch.

Correspondingly, FIG. 9 presents a more detailed illustration of the structural solution relating to the safety circuit 21 according to the second embodiment of the invention. In this solution, too, the bypass switch 17 is attached to the lower part of the elevator car 2, e.g. on the side of the elevator car. Correspondingly, attached to the wall of the elevator shaft at the lowest floor level 4 or close to it is a ramp 18*a* serving as a counterpart of the bypass switch 17 and consisting of e.g. a plate rail extending towards the elevator car 2 from the shaft wall. The upper part of the ramp is in an inclined position to allow the roller-like follower element 19 to move onto it, the lower part of the ramp 18*a* being in a substantially vertical position. The placement of the lower part of the ramp 18*a* in relation to the bypass switch 17 in the low position is so designed that, when the elevator car 2 is at the lowest landing floor 4, the roller-like follower element 19 of the bypass switch 17 is on the vertical portion of the ramp 18*a*. For reliable operation, however, the opening operation of the contact 17*a* of the bypass switch 17 has to be ensured by positive control, because the contact may e.g. get jammed so that it can not opened by mere spring force or a corresponding force used in a normal situation. Positive opening of the contact 17*a* is implemented using an oblique counterelement 20 placed in the elevator shaft above the ramp 18*a* so that, as the elevator car 2 is moving upwards, the roller-like follower element 19 will meet the counterelement 20 after leaving the ramp 18*a* and follow the lower surface of the counterelement 20, positively pulling the contact 17*a* into the open position. The mechanism for positive opening operation of the contact 17*a* can also be seen in FIGS. 10*b*, 11 and 12*b* below.

Figure 10A:
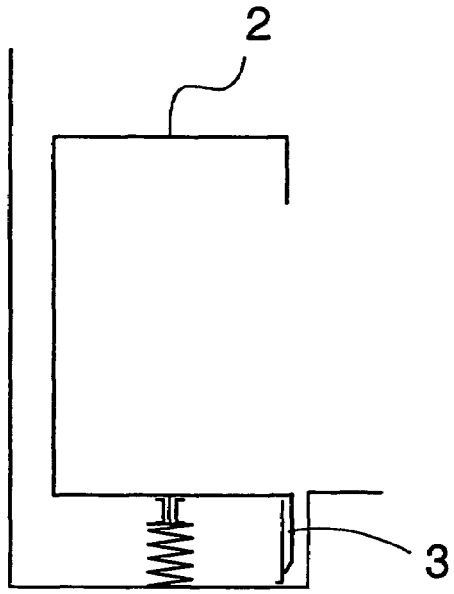
FIG. 10*a* presents a diagrammatic and simplified side view of an elevator car at the lowest landing floor.
Figure 10B:
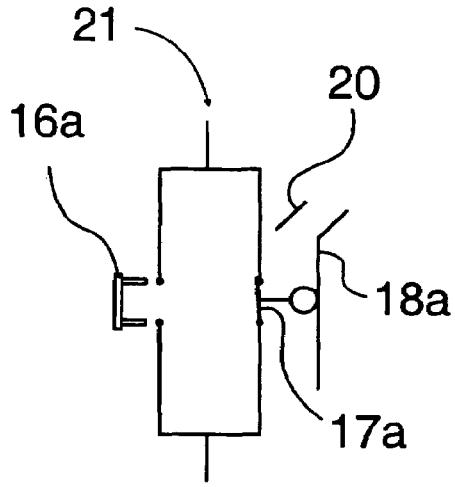
FIG. 10*b* presents a diagrammatic and simplified side view of the safety circuit connection according to the second embodiment of the invention when the elevator car is at the lowest landing floor as shown in FIG. 10*a*.

FIGS. 10*a* and 10*b* represent a situation with the elevator car at the lowest landing floor 4. The elevator car 2 has descended to the lowest landing floor 4 and, due to the low pit, the lower part 9 of the toe guard 3 has been pushed upwards into the upper part 6. FIG. 10*b* shows that the contact 16*a* of the safety circuit switch 16 has opened, but because the bypass switch 17 is in an activated state as it is on the ramp 18*a*, the contact 17*a* of the bypass switch 17 is closed and bypasses the safety circuit 21 so that the elevator receives its normal operating current and no failure situation occurs.

Figure 11A:
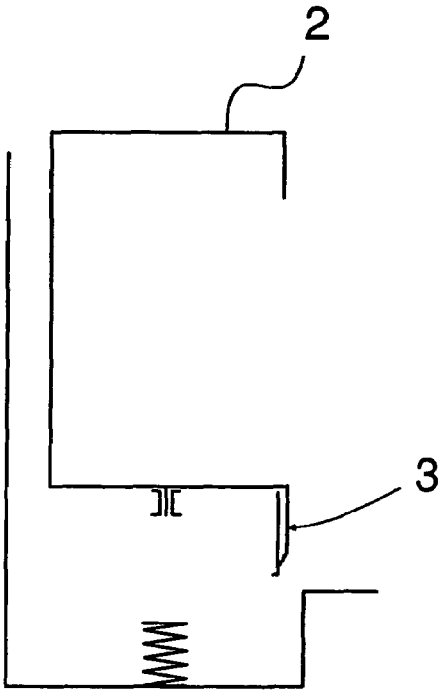
FIG. 11*a* presents a diagrammatic and simplified side view of an elevator car having just left the lowest landing floor and with the toe guard stuck in the high position.
Figure 11B:
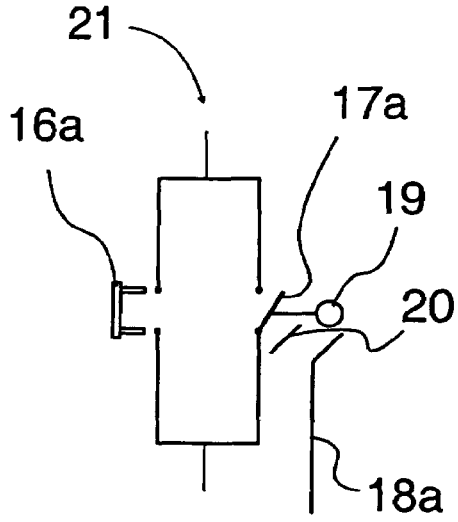
FIG. 11*b* presents a diagram of the safety circuit connection according to the second embodiment of the invention in a failure situation when the elevator car is in a position as shown in FIG. 11*a*.

Correspondingly, FIGS. 11*a* and 11*b* represent a situation where the elevator car 2 has just started moving upwards from the lowest landing floor 4 and the lower part 9 of the toe guard 3 is stuck inside the upper part 6 and has not come down to its normal position as it should have. In this situation, the contact 16*a* of the switch 16 of the safety circuit 21 remains in the open position and, as the bypass switch 17 has left the ramp 18, contact 17*a* has also been opened by positive control, assisted by the counterelement 20, so the safety circuit 21 has switched off the supply of operating current to the elevator and the elevator car 2 has stopped in consequence of the failure situation.

Figure 12A:
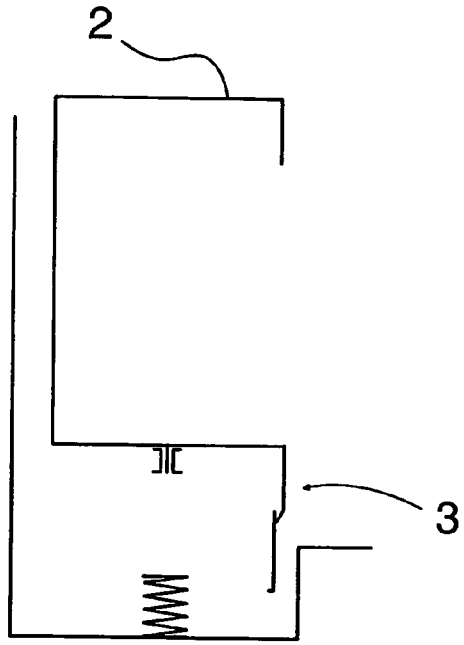
FIG. 12*a* presents a diagrammatic and simplified side view of an elevator car having just left the lowest landing floor and with the toe guard returned to the low position, FIG. 12*b* a diagram of the safety circuit connection according to the second embodiment of the invention in a normal situation when the elevator car is in a position as shown in FIG. 12*a*.
Figure 12B:
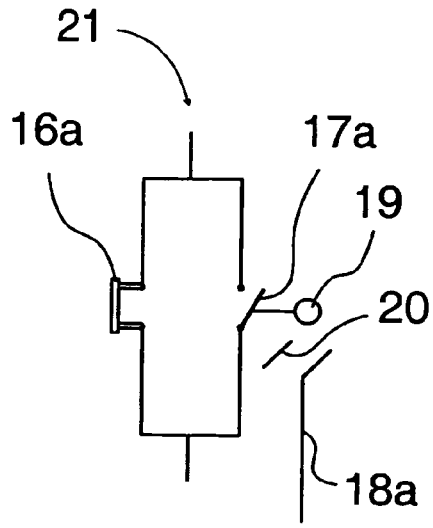

FIGS. 12*a* and 12*b* represent a situation corresponding to FIGS. 11*a* and 11*b* when the lower part 9 of the toe guard 3 has come down to its normal low position after the departure of the elevator car 2. In this case, the contact 16*a* of the safety circuit switch 16 has closed and, after the roller-like follower element 19 has left the ramp 18*a*, contact 17*a* has been opened by positive control assisted by the counterelement 20, but the safety circuit 21 still allows the flow of operating current via contact 16*a* and the elevator car 2 continues its upward movement in the normal way.

Figure 13A:
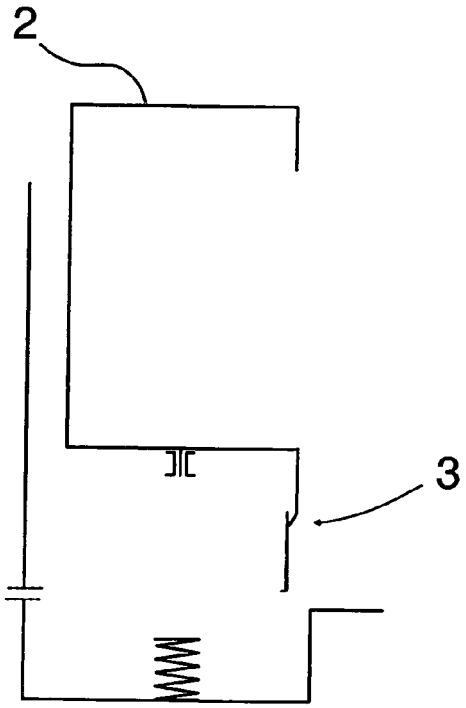
FIG. 13*a* presents a diagrammatic and simplified side view of an elevator car in an elevator shaft above the lowest landing floor and with the toe guard in the normal position.
Figure 13B:
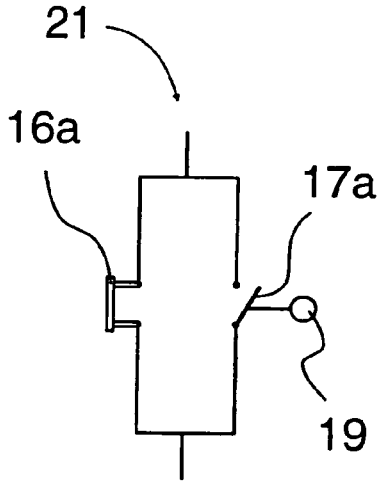
FIG. 13*b* presents a diagram of the safety circuit connection according to the second embodiment of the invention when the elevator car is in a position as shown in FIG. 13*a*.

FIGS. 13*a* and 13*b* represent a normal situation when the elevator car 2 is at any position in the elevator shaft 1 so that the bypass switch 17 is above the ramp 18*a*. In such a situation the lower part 9 of the toe guard 3 is in its normal low position, the contact 16*a* of the safety circuit switch 16 is closed and the contact 17*a* of the bypass switch 17 is open, so the safety circuit 21 allows the flow of operating current via contact 16*a* and the elevator car 2 moves normally.

The embodiment presented in FIGS. 9-13*b* have the advantage that the safety circuit 21 switches off the supply of operating current to the elevator even in situations where an obstacle having got in the way of the toe guard 3 lifts the lower part 9 of the toe guard 3 into the upper part 6 when the elevator car 2 is at any other position in the elevator shaft than at the lowest landing floor 4.

If the pit 5 of the elevator shaft 1 has a height larger than the total height of the toe guard 3, in which case the lower part 9 of the toe guard will not rise into the upper part 6 when the elevator car 2 is at the lowest landing floor 4, no bypass switch 17 and no ramp 18 or 18*a* are needed because there is no need to ensure that the lower part 9 returns to the low position. In this case, operating current is interrupted in a failure situation by the contact 16*a* of the safety circuit switch 16.

It is obvious to the person skilled in the art that the invention are not limited to the example described above, but that it may be varied within the scope of the claims presented below. Thus, the toe guard may also be made from more than two telescoping parts. Likewise, a safe toe guard can be made from two or more parts placed side by side which move into their respective upper parts in such manner that only that part moves to which a force is applied from below. This provides the advantage that the opening leading into the shaft remains as well closed as possible, because only a relatively narrow part of the toe guard slides upwards.

Figure 14:
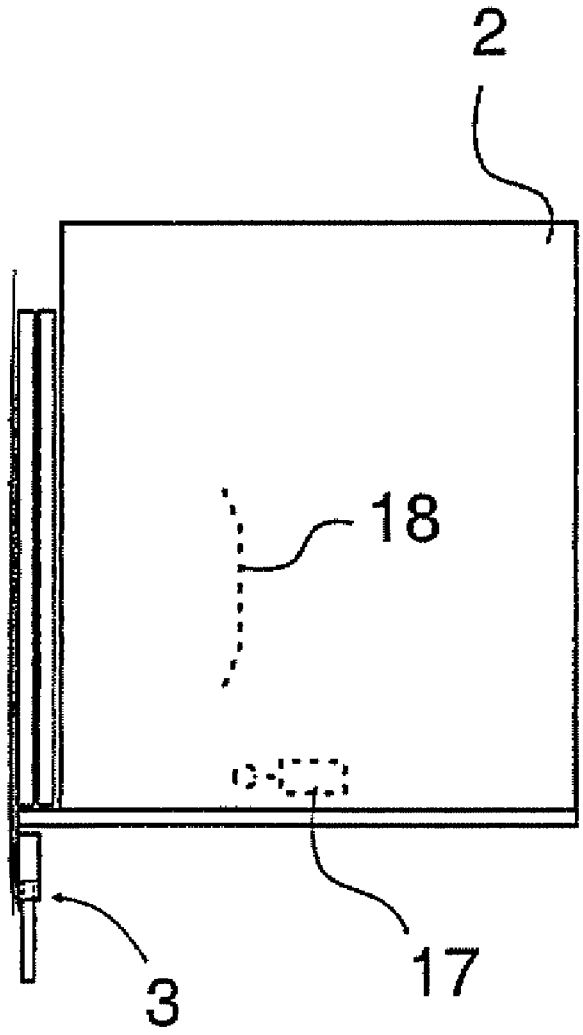
FIG. 14 presents a diagrammatic view of the elevator car with a counterpart and a bypass switch on the shaft wall.
Figure 15:
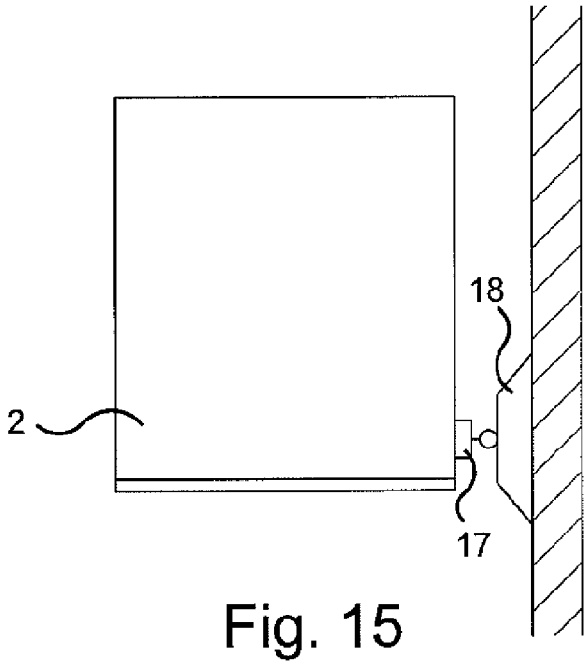
FIG. 15 presents a digrammatic view of the elevator car from the rear with the bypass switch mounted on the side of the car.
Figure 16:
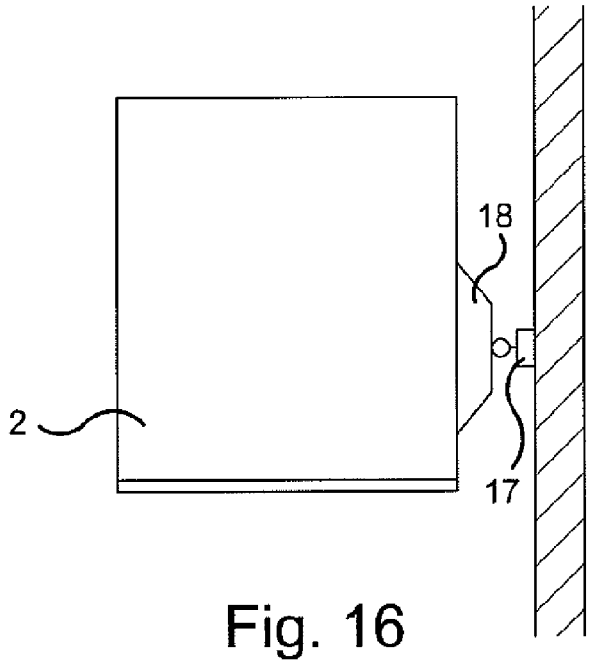
FIG. 16 presents a digrammatic view of the elevator car from the rear with the bypass switch mounted on the shaft wall.

It is likewise obvious to the person skilled in the art that the placement and structural solutions of the safety circuit bypass switch 17 may differ from the above description. The bypass switch 17 may be placed e.g. in the upper part of the elevator car or it may also be mounted in the elevator shaft as seen in FIG. 14. In this case, the counterpart 18, 18*a* also has to be placed correspondingly. FIG. 15 shows a rear view of the elevator car 2 including the bypass switch 17 is mounted on the lower part of the car and which has a counter part 18 mounted on the wall of the shaft. FIG. 16 shows the reverse situation where the bypass switch 17 is mounted on the wall of the elevator shaft and the counterpart is mounted on the side of the car.

It is further obvious to the person skilled in the art that, instead the above-described safety circuit applications, the returning movement of the toe guard to its low position can also be ensured by using an ordinary single- or dual-channel monitoring circuit, in which it is possible to use economical microswitches.

The invention claimed is:

1. A safety device arrangement for an elevator door opening, said safety device arrangement comprising:

at least a toe guard placed substantially at the lower edge of an elevator car;

a safety circuit connected to an elevator system;

a safety circuit switch placed on the toe guard; and a bypass switch connected to the safety circuit, said bypass switch being fitted to bypass the safety circuit switch by closing a bypass circuit around switch at least when the elevator car is at or close to the lowest landing floor, wherein the toe guard comprises an upper part and a lower part moving in a telescoping manner relative to the upper part, said lower part being fitted to slide upwards inside the upper part when it meets an obstacle, and the safety circuit switch comprised in the toe guard is fitted to break the safety circuit when the lower part moves in relation to the upper part.

2. The safety device arrangement according to claim 1, wherein between the upper part and the lower part is a safety circuit switch which together with the bypass switch is connected to the elevator safety circuit in such manner that, when the lower part of the toe guard rises upwards inside the upper part, the safety circuit stops the motion of the elevator car except at the lowest landing floor.

3. The safety device arrangement according to claim 1, wherein the bypass switch is placed on the elevator car, and that the counterpart of the bypass switch is placed on the wall of the elevator shaft at or close to the lowest landing floor.

4. The safety device arrangement according to claim 1, wherein the bypass switch is placed in the lower part of the elevator car, and the counterpart of the bypass switch is placed on the wall of the elevator shaft at or close to the lowest landing floor.

5. The safety device arrangement according to claim 1, wherein the bypass switch is placed on the wall of the elevator shaft at or close to the lowest landing floor, and the counterpart of the bypass switch is placed on the elevator car.

* * * * *